United States Patent [19]

Filion et al.

[11] Patent Number: 5,036,361

[45] Date of Patent: Jul. 30, 1991

[54] JOB REQUIREMENTS CALCULATION AND DISPLAY

[75] Inventors: Joseph L. Filion; Douglas F. Sundquist, both of Rochester; Paul F. Schmitt, Palmyra; Eugene S. Evanitsky; Riley L. Warddrip, both of Pittsford, all of N.Y.

[73] Assignee: Xerox Corporation, Stamford, Conn.

[21] Appl. No.: 500,840

[22] Filed: Mar. 21, 1990

[51] Int. Cl.[5] ..... G03G 15/00; G03G 21/00

[52] U.S. Cl. ..... 355/209; 355/77; 355/133; 340/722

[58] Field of Search ..... 355/209, 206, 77, 204, 355/308, 309, 133; 340/722, 750, 753

[56] References Cited

U.S. PATENT DOCUMENTS 4,417,350 11/1983 Ito et al. .
4,503,960 3/1985 Kaelman et al. .
4,511,243 4/1985 Smith .
4,627,715 12/1986 Kikuno .
4,716,864 3/1989 Tanka .
4,734,747 3/1988 Okuda et al. .
4,821,070 4/1989 Nakade et al. .
4,853,867 8/1989 Matsumura ..... 340/722 X
4,860,055 8/1989 Ohira et al. ..... 355/308

*Primary Examiner*—R. L. Moses
*Attorney, Agent, or Firm*—Ronald F. Chapuran

[57] ABSTRACT

A method of providing a prominent time of completion display and percentage of completion display for a given job requirement and providing an indication of the amount of paper stock required from several sources of paper stock in a printing system including the steps of responding to entered job requirements to calculate a total time of completion for the given job and the paper stock required from each of the paper stock sources, displaying the total time of completion at the operator interface, displaying the amount of paper stock required from each of the paper stock sources, and initiating the job run and during the job run periodically determining the time to completion of the remaining portion of the job and displaying the time to completion in a prominent bar graph.

8 Claims, 6 Drawing Sheets

JOB REQUIREMENTS CALCULATION AND DISPLAY

BACKGROUND OF THE INVENTION

The invention relates to a system for controlling reproduction machines such as copiers and printers, and more particularly, to methods and apparatus for calculating and displaying job requirements such as job completion time and paper requirements.

As reproduction machines such as copiers and printers become more complex and versatile in the jobs they can do, the user interface between the machine and the operator or user, which in essence permits the dialogue between operator and machine, must necessarily be expanded if full and efficient utilization of the machine is to be realized. This is particularly important in a reproduction center or multi-machine environment where an operator is always concerned about the availability of machine time as well as the requirements for supplies such as copy sheets.

It is important for efficiency of operation for an operator to be ready to load a machine with documents and begin a second job run as soon as possible after the completion of a first job run. Yet, it is wasteful of time for an operator to simply wait for the first job to be completed when other tasks could be accomplished while the first job is in process.

It is also very inefficient for an operator to discover during the processing of a reproduction job that the machine has stopped because of a lack of paper in the supply tray. The problem becomes greater in complex machines with several trays holding a variety of stock. Each time the operator must return to the machine and resupply a paper tray there is a significant loss in productivity.

Various prior art techniques are directed to operator determination of job requirements, for example:

U.S. Pat. No. 4,627,715 top Kikuno discloses a product monitoring system for a copier that determines if there is sufficient paper to complete a programmed job based on the size of the job. A warning signal is produced if the paper supply is insufficient.

U.S. Pat. No. 4,503,960 to Koelman et al. discloses a supply monitoring system for a copying machine. The system compares a measured value of the paper supply to an amount of paper required for a job and determines if there is sufficient supply to complete the job. A signal is produced in response to an insufficient paper supply.

U.S. Pat. No. 4,511,243 to Smith discloses a system for determining the time remaining to complete a copy job. A time value is computed using a signal indicative of the time to produce a single copy and a signal indicative of the number of copies remaining.

U.S. Pat. No. 4,816,864 to Tanaka et al discloses a system that permits an operator to be informed of the exact time that a programmed job will be completed.

One difficulty with the prior art systems is that even if the time to completion is continuously determined, it is generally not provided in a format that is easily observable or understood by the operator except under close inspection. It would be desirable for an operator, especially one tending to a plurality of machines, to be able to easily observe the percentage completion or time required for completion of a job for any one of the machines regardless of the location of the operator in the reproduction center, and be able to restart the machine as soon as possible to begin another job run.

Another difficulty with the prior art systems is the deficiency of informing the operator of the exact number of copy sheets required for a particular job in each of a variety of copy sheet sources. For example, a particular job might require "x" number of copy sheets from tray 1, "y" number of cover sheets from tray 2, and "z" number of tab inserts from tray 3. It would be much more efficient to complete job runs, if the operator knew precisely the paper stock required before the start of the job run, to eliminate inefficient job run stoppages.

It is an object of the present invention, therefore, to provide a new and improved technique for providing an operator at the beginning of a job run an exact count of the paper stock required at each paper tray to complete the job. Another object of the present invention is to provide an operator with a prominent display of the amount of time required to complete a job as well as a prominent display of the percentage completion of the job without the need for the operator to closely monitor the machines. Further advantages of the present invention will become apparent as the following description proceeds and the features characterizing the invention will be pointed out with particularity in the claims annexed to and forming a part of this specification.

SUMMARY OF THE INVENTION

Briefly, the present invention is concerned with the method of providing a prominent time of completion and percentage of completion display for a given job requirement and providing an indication of the amount of copy stock required from several sources of paper stock in a printing system including the steps of responding to entered job requirements to calculate a total time of completion for the given job and the paper stock required from each of the paper stock sources, displaying the total time of completion at an operator interface, displaying the total number of paper stock required from each of the paper stock sources, and initiating the job run and during the job run concurrently determining the time to completion of the remaining portion of the job and displaying the percentage in a prominent bar graph.

For a better understanding of the present invention, reference may be had to the accompanying drawings wherein the same reference numerals have been applied to like parts and wherein:

IN THE DRAWINGS

DETAILED DESCRIPTION OF THE INVENTION

Figure 1:
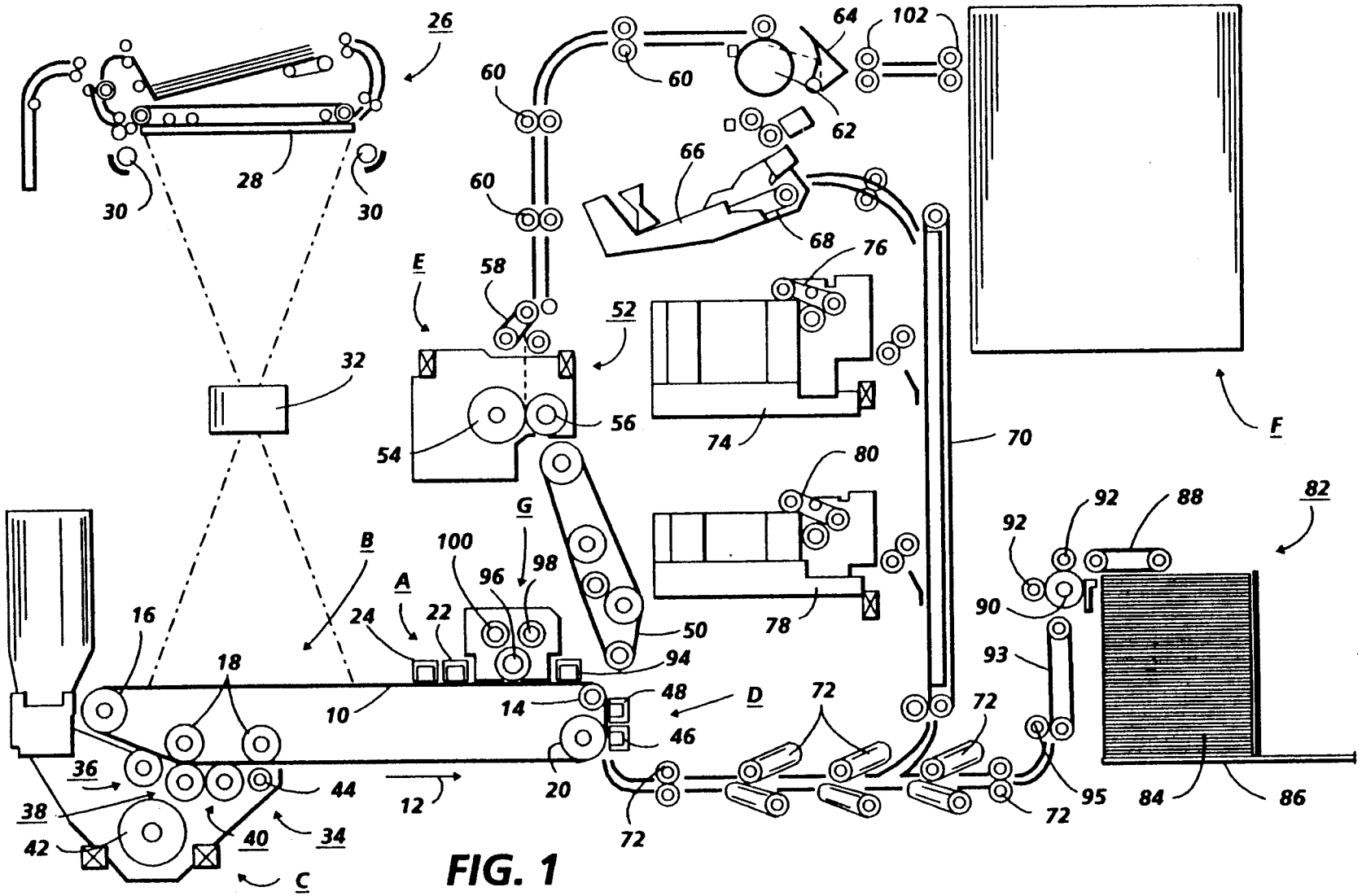
FIG. 1 is a schematic elavational view depicting various operating components and subsystems of a typical reproduction machine.

Referring to FIG. 1, there is shown an electrophotographic reproduction machine composed of a plurality of programmable components and subsystems which cooperate to carry out the copying or printing job programmed through a touch dialogue User Interface (U.I.). The machine employs a photoconductive belt 10. Belt 10 is entrained about stripping roller 14, tensioning roller 16, idler rollers 18, and drive roller 20. Drive roller 20 is rotated by a motor coupled thereto by suitable means such as a belt drive. As roller 20 rotates, it advances belt 10 in the direction of arrow 12 through the various processing stations disposed about the path of movement thereof.

Initially, the photoconductive surface of belt 10 passes through charging station A where two corona generating devices, indicated generally by the reference numerals 22 and 24 charge photoconductive belt 10 to a relatively high, substantially uniform potential. Next, the charged photoconductive belt is advanced through imaging station B. At imaging station B, a document handling unit 26 sequentially feeds documents from a stack of documents in a document stacking and holding tray into registered position on platen 28. A pair of Xenon flash lamps 30 mounted in the optics cavity illuminate the document on platen 28, the light rays reflected from the document being focused by lens 32 onto belt 10 to expose and record an electrostatic latent image on photoconductive belt 10 which corresponds to the informational areas contained within the document currently on platen 28. After imaging, the document is returned to the document tray via a simplex path when either a simplex copy or the first pass of a duplex copy is being made or via a duplex path when a duplex copy is being made.

The electrostatic latent image recorded on photoconductive belt 10 is developed at development station C by a magnetic brush developer unit 34 having three developer rolls 36, 38 and 40. A paddle wheel 42 picks up developer material and delivers it to the developer rolls 36, 38. Developer roll 40 is a cleanup roll while a magnetic roll 44 is provided to remove any carrier granules adhering to belt 10.

Following development, the developed image is transferred at transfer station D to a copy sheet. There, the photoconductive belt 10 is exposed to a pre-transfer light from a lamp (not shown) to reduce the attraction between photoconductive belt 10 and the toner powder image. Next, a corona generating device 46 charges the copy sheet to the proper magnitude and polarity so that the copy sheet is tacked to photoconductive belt 10 and the toner powder image attracted from the photoconductive belt to the copy sheet. After transfer, corona generator 48 charges the copy sheet to the opposite polarity to detach the copy sheet from belt 10.

Following transfer, a conveyor 50 advances the copy sheet bearing the transferred image to fusing station E where a fuser assembly, indicated generally by the reference numeral 52 permanently affixes the toner powder image to the copy sheet. Preferably, fuser assembly 52 includes a heated fuser roller 54 and a pressure roller 56 with the powder image on the copy sheet contacting fuser roller 54.

After fusing, the copy sheets are fed through a decurler 58 to remove any curl. Forwarding rollers 60 then advance the sheet via duplex turn roll 62 to gate 64 which guides the sheet to either finishing station F or to duplex tray 66, the latter providing an intermediate or buffer storage for those sheets that have been printed on one side and on which an image will be subsequently printed on the second, opposed side thereof. The sheets are stacked in duplex tray 66 face down on top of one another in the order in which they are copied.

To complete duplex copying, the simplex sheets in tray 66 are fed, in seriatim, by bottom feeder 68 back to transfer station D via conveyor 70 and rollers 72 for transfer of the second toner powder image to the opposed sides of the copy sheets. The duplex sheet is then fed through the same path as the simplex sheet to be advanced to finishing station F.

Copy sheets are supplied from a secondary tray 74 by sheet feeder 76 or from the auxiliary tray 78 by sheet feeder 80. Sheet feeders 76, 80 are friction retard feeders utilizing a feed belt and take-away rolls to advance successive copy sheets to transport 70 which advances the sheets to rolls 72 and then to transfer station D.

A high capacity feeder 82 is the primary source of copy sheets. Tray 84 of feeder 82, which is supported on an elevator 86 for up and down movement, has a vacuum feed belt 88 to feed successive uppermost sheets from the stack of sheets in tray 84 to a take away drive roll 90 and idler rolls 92. Rolls 90, 92 guide the sheet onto transport 93 which in cooperation with idler roll 95 and rolls 72 move the sheet to transfer station station D.

After transfer station D, photoconductive belt 10 passes beneath corona generating device 94 which charges any residual toner particles remaining on belt 10 to the proper polarity. Thereafter, a pre-charge erase lamp (not shown), located inside photoconductive belt 10, discharges the photoconductive belt in preparation for the next charging cycle. Residual particles are removed from belt 10 at cleaning station G by an electrically biased cleaner brush 96 and two de-toning rolls 98 and 100.

The various functions of machine 5 are regulated by a controller which preferably comprises one or more programmable microprocessors. The controller provides a comparison count of the copy sheets, the number of documents being recirculated, the number of copy sheets selected by the operator, time delays, jam corrections, etc.. As will appear, programming and operating control over machine 5 is accomplished through a User Interface. Operating and control information, job programming instructions, etc. are stored in a suitable memory which includes both ROM and RAM memory types. Conventional sheet path sensors or switches may be utilized to keep track of the position of the documents and the copy sheets. In addition, the controller regulates the various positions of the gates depending upon the mode of operation selected.

Figure 2:
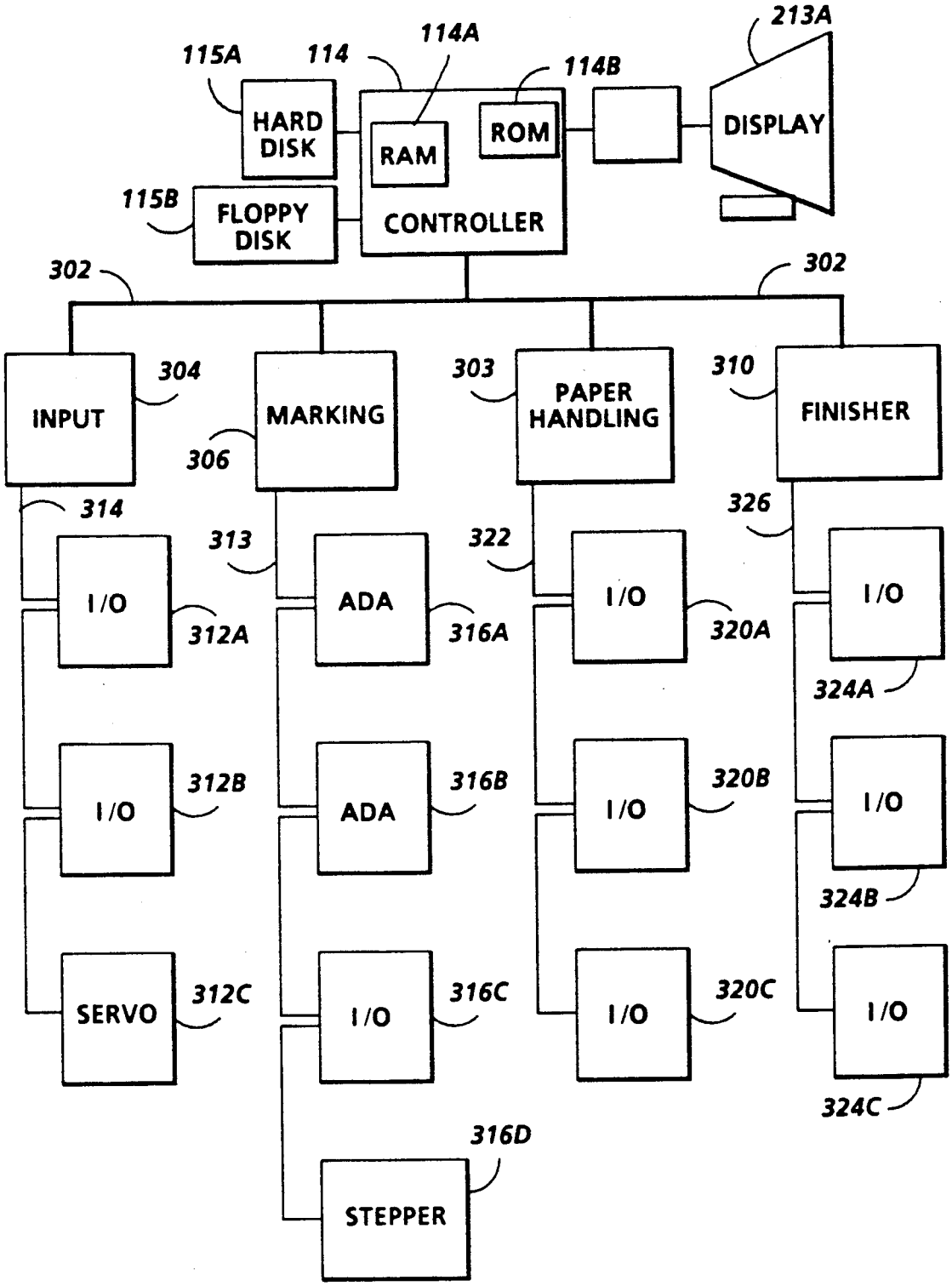
FIG. 2 is a block diagram of the operating control systems and memory for the machine shown in FIG. 1.

With reference to FIG. 2, the memory includes a hard or rigid disk drive 115A and a floppy disk drive 115B connected to Controller 114. In a preferred embodiment, the rigid disks are two platter, four head disks with a formatted storage capacity of approximately 20 megabytes. The floppy disks are 3.5 inch, dual sided micro disks with a formatted storage capacity of approximately 720 kilobytes. Preferably, all of the control code and screen display information for the machine is loaded from the rigid disk at machine power up. Changing the data that gets loaded into the machine for execution can be done by exchanging the rigid disk in the machine 5 for another rigid disk with a different version of data or by modifying the contents of the current rigid disk by transferring data from one or more floppy disks onto the rigid disk using the floppy disk drive built into the machine 5. Suitable display 213A of U.I. 213 is also connected to Controller 114 as well as a shared line system bus 302.

The shared line system bus 302 interconnects a plurality of core printed wiring boards including an input station board 304, a marking imaging board 306, a paper handling board 308, and a finisher/binder board 310. Each of the core printed wiring boards is connected to local input/output devices through a local bus. For example, the input station board 304 is connected to digital input/output boards 312A and 312B and servo board 312C via local bus 314. The marking imaging board 306 is connected to analog/digital/analog boards 316A, 316B, digital input/output board 316C, and stepper control board 316D through local bus 318. In a similar manner, the paper handling board 308 connects digital input/output boards 320A, B and C to local bus 322, and finisher/binder board 310 connects digital input/output boards 324A, B and C to local bus 326.

Figure 3:
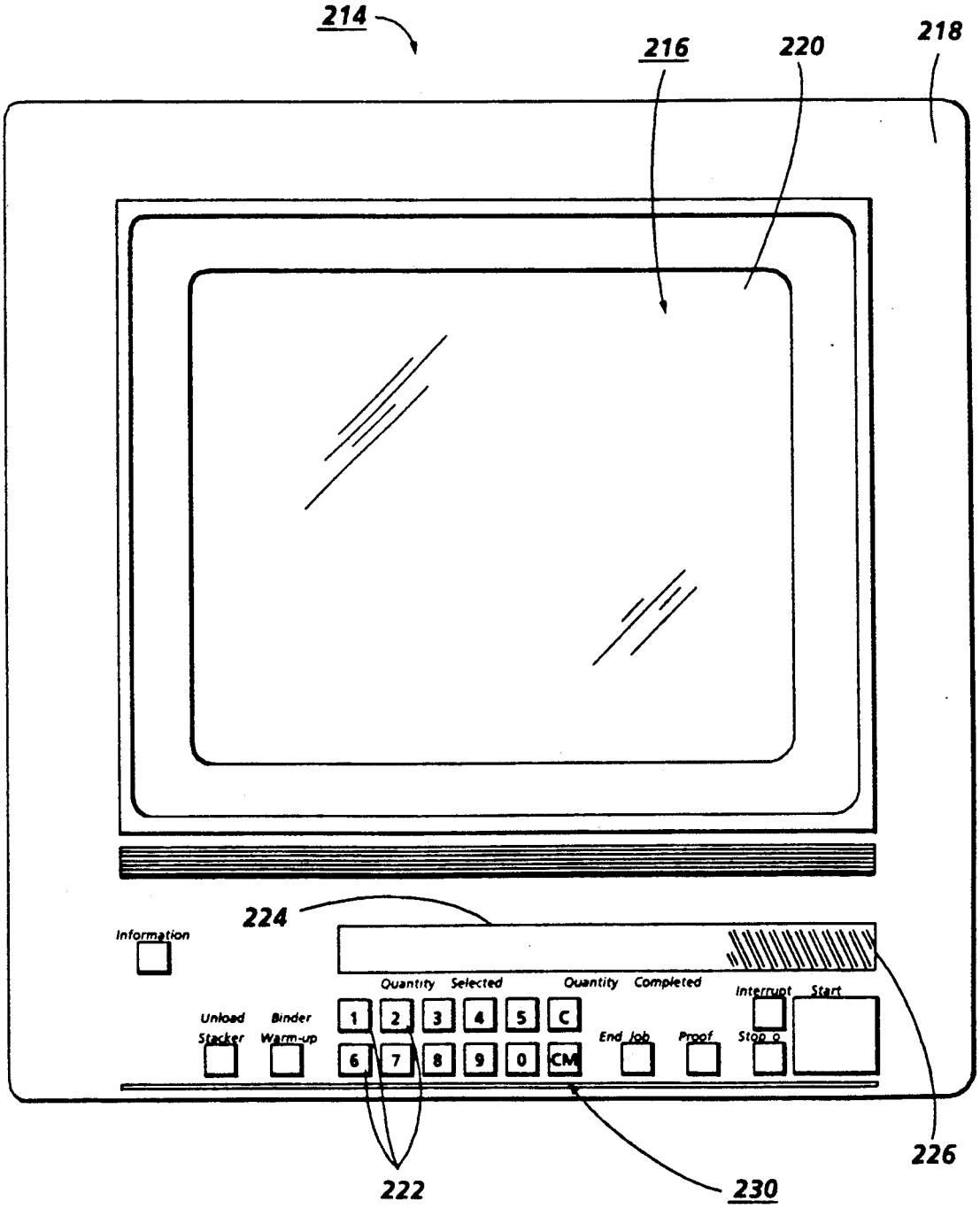
FIG. 3 is a front view of the User Interface color touch monitor for the machine of FIG. 1 showing the soft button display screen and hard button control panel.

Referring to FIG. 3, monitor 214 provides an operator user interface with hard and soft touch control buttons enabling communication between operator and machine 10. Monitor 214 comprises a suitable color cathode ray tube 216 of desired size and type having a peripheral framework forming a decorative bezel 218 thereabout. Bezel 218 frames a rectangular video display screen 220 on which soft touch buttons in the form of icons or pictograms and messages are displayed as will appear together with a series of hard control buttons 222 and 10 seven segment displays 224 there below. Displays 224 provide a display for copy "Quantity Selected", copy "Quantity Completed", and an area 226 for other information.

Hard control buttons 222 comprise "0–9" buttons providing a keypad 230 for programming copy quantity, code numbers, etc.; a clear button "C" to reset display 224; a "Start" button to initiate print; a clear memory button "CM" to reset all dialogue mode features to default and place a "1" in the least significant digit of display 224; an "Unload Stacker" button requesting transfer of the contents of stacker 128; a "Stop" button to initiate an orderly shutdown of machine 5; a "Binder Warm-up" button to initiate warm-up of binder 126; an "Interrupt" button to initiate a job interrupt; a "Proof" button to initiate making of a proof copy; an "End Job" button to end the current job; and an "i" button to initiate a request for information.

Figure 4:
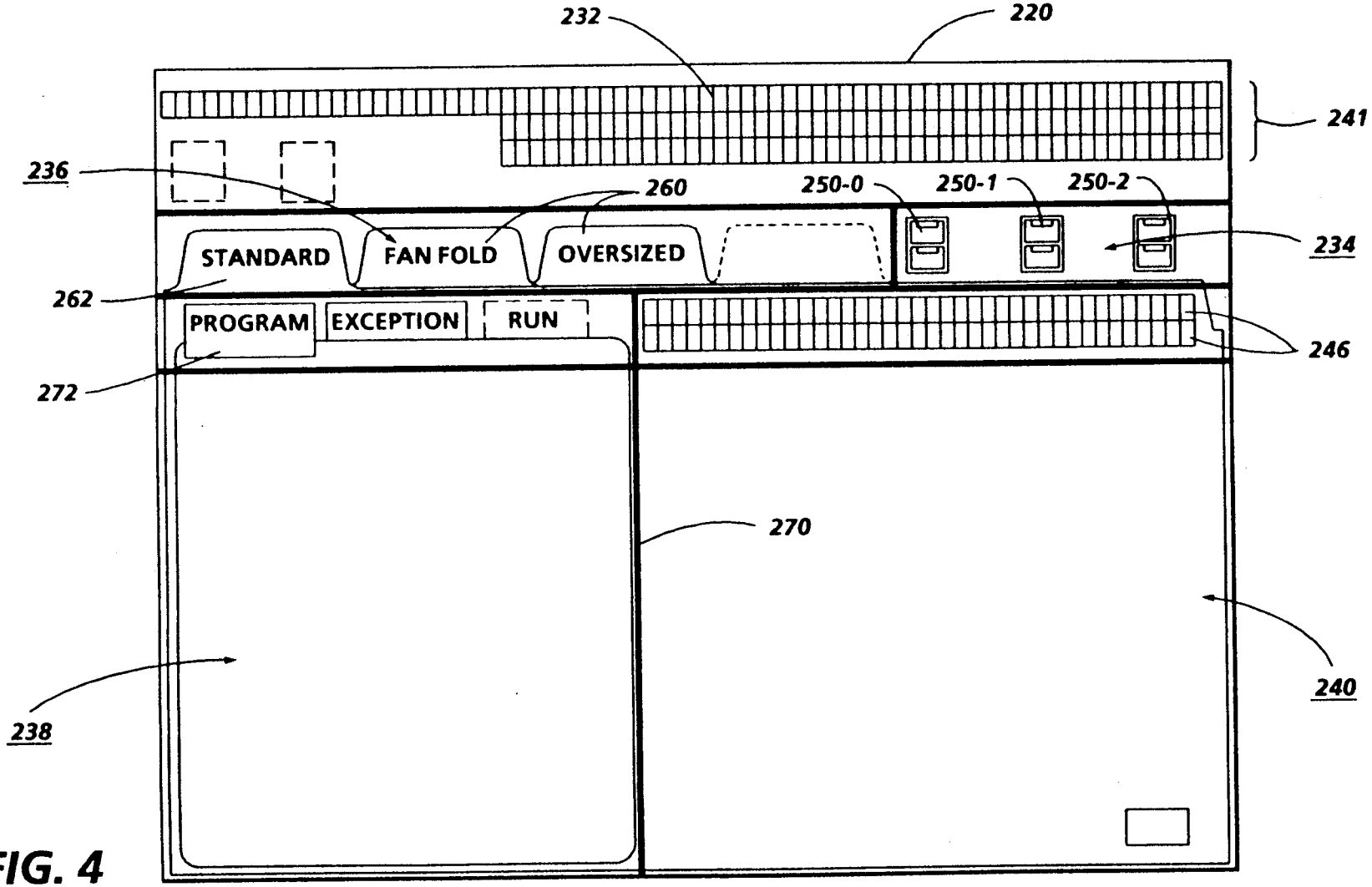
FIG. 4 is a front view of the touch monitor screen with the principal elements of the soft touch dialogue displayed.

Referring now to FIG. 4, for dialogue purposes, screen 220 of monitor 214 is separated into five basic display areas, identified as a message area 232, a dialogue mode selection area 234, a dialogue pathway selection area 236, a scorecard selection area 238, and a work selection area 240.

Message area 232 consists of 3 lines 241 located at the top of screen 220. In addition, two programming conflict message lines 246 are provided in work selection area 240. The dialogue mode selection area 234 comprises an active area containing certain top level dialogue mode controls available to the operator. The mode controls are soft touch buttons 250-0, 250-1, and 250-2 in the form of icons representing file cabinets located on the right side of the screen 220 directly below message area 232.

The dialogue pathway selection area 236 and the scorecard selection area 238 basically simulate a card within a card filing system with primary dialogue pathway file folders 260 and secondary file cards, the latter being referred to as scorecards 270. As will appear, scorecards 270 provide additional programming pathway options. File folders 260 and scorecards 270 are arranged in overlaying relation one in front of the other. The dialogue pathway file folders 260, which are located beneath message area 232 and which extend up into the dialogue mode area 234, each have an outwardly projecting touch tab 262 along the top edge identifying the dialogue pathway represented by the folder, as for example STANDARD, FANFOLD, OVERSIZED, etc.. To allow the file folders 260 to be distinguished from one another without the need to reshuffle the folders each time it is desired to display a folder hidden behind the folder currently displayed, each tab 262 is offset from the other so that tabs 262 are always visible whatever folder is displayed.

Figure 5:
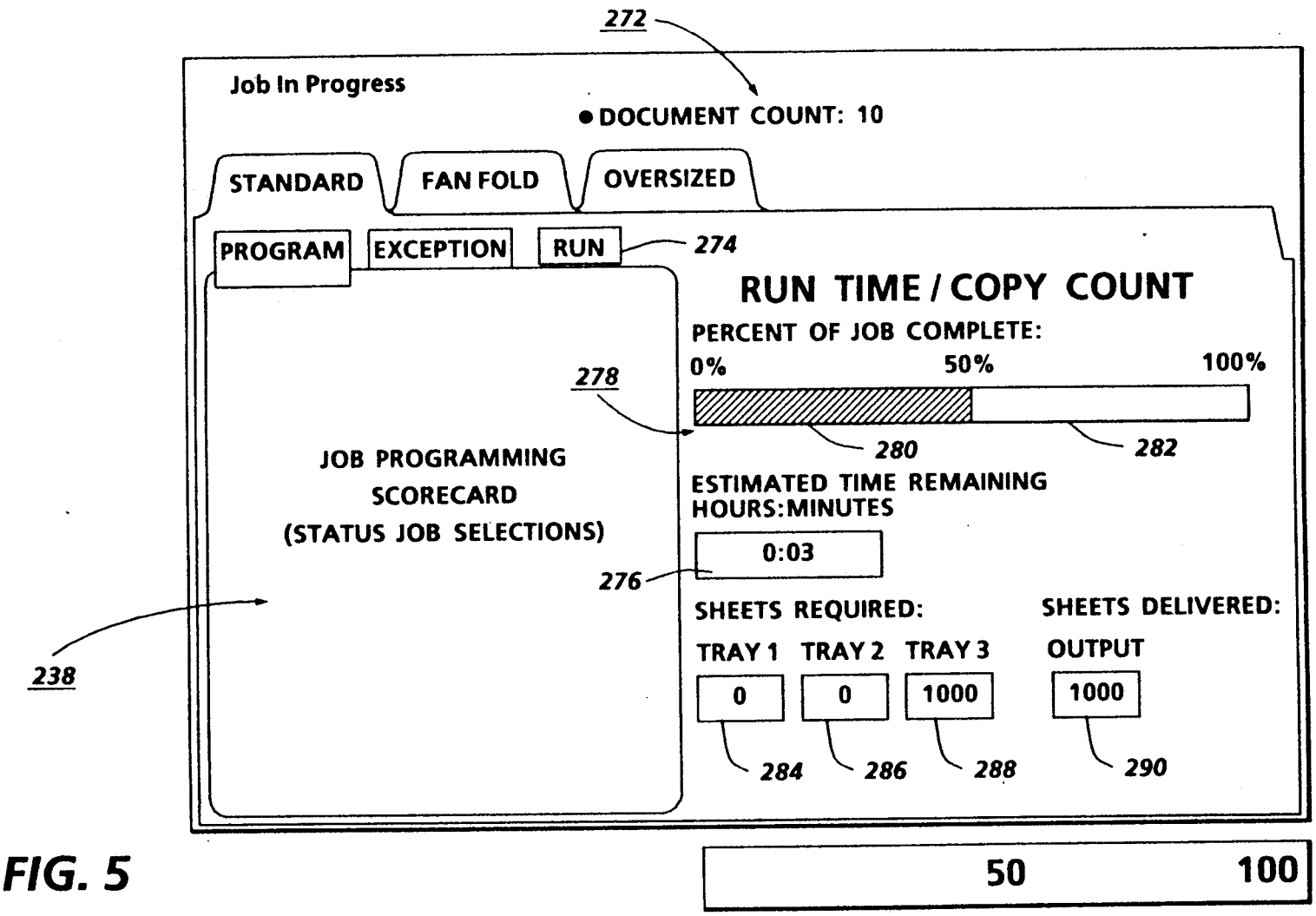
FIG. 5 is a front view of the touch monitor screen shown in FIG. 4 depicting the sheets required and job completion time displays including the percentage completion graph and in accordance with the present invention.

Scorecard selection area 238 appears in the lower left corner of screen 220 beneath dialogue selection area 234 and extends to the border of work selection area 240. Scorecard selection area 238 contains a file of scorecards 270 which present the features (first level program selections) available with each of the dialogue pathway file folders 260. As seen in FIG. 5 for example, area 238 displays the features (first level program selections) resident with the currently selected scorecard, such selections remaining at previously selected options until either timeout or the "CM" button (FIG. 4) is pressed. Two or three scorecards 270 are typically provided, depending on the dialogue pathway file folder 260 selected. Scorecards 270 each comprise a relatively small file card arranged in overlaying relation to one another so as to simulate a second but smaller card file. Each scorecard 270 has a touch tab 272 displaying the programming pathway options available with the scorecard, such as PROGRAM, EXCEPTION, or RUN.. Scorecard tabs 272 are offset from one another to enable the identity of each scorecard to be determined whatever its position in the scorecard file. Additionally, scorecard tabs 272 are shaped different than the dialogue pathway file folder tabs 262 to prevent confusion.

Work selection area 240 appears in the lower right portion of screen 220, area 240 being beneath the dialogue pathway area 236 and extending from the edge of scorecard selection area 238 to the right side of screen 220. The top two lines 246 of the work selection area 240 are reserved for programming conflicts and prompts with the remaining area used for displaying the feature options (second level program selections) available with the first level program selection that is touched on the scorecard currently selected, an example of which is seen in FIG. 18. As will appear, the operator can scan and make a selection within the work area or pick another scorecard item.

In order for the soft touch buttons (i.e., icons) on screen 220 to provide information regarding both their current selection state and their current status, a display convention is provided that will allow the operator to quickly scan the display and determine current feature selections. Referring to Table I, unselected features that are selectable are indicated by an outlined icon with a shadowed background while selected features that are selectable are indicated by a color-filled icon with a shadowed background. Unselected features that are not selectable are indicated by an outlined icon without a shadowed background while selected features that are not selectable are indicated by a color-filled icon without a shadowed background.

In cases where an unselected feature that is not selectable is touched, a message will be displayed in the programming conflict area 246 of screen 220. There are five operating states for U.I. 213 consisting of (1) CURRENT JOB, (2) PROGRAM AHEAD (3) TOOLS, (4) FAULTS, and (5) INFORMATION. The INFORMATION state is entered by means of a hard control button "i" on bezel 218 while the FAULTS state is in the form of a file card that overlays the file cards currently displayed in the event of a fault. The CURRENT JOB, PROGRAM AHEAD, and TOOLS states are entered by pressing the soft touch buttons 250-0, 250-1 and 250-2 respectively displayed on screen 220 in the Dialogue Mode Selection area 234.

For purposes of discussing the present invention, U.I. 213 is presumed to be in the CURRENT JOB state as a result of the actuation of soft touch button 250-0. When entered in the CURRENT JOB state, the dialogue pathway file folders 260 tabbed STANDARD, OVERSIZED, and FANFOLD are displayed providing various dialogue pathway selections in the form of scorecards 270. The function and the behavior of these tabbed file folders within the dialogue pathway selection area 236 for the "Job Complete", "Job Incomplete", and "Print" cases as well as further details of the above described system are further described in application Ser. No. 07/164,365 filed Mar. 3, 1988 and incorporated herein.

With reference to FIG. 5, in accordance with the present invention, there is disclosed a score card tab RUN, as illustrated at 274, included with the standard dialogue pathway file folder 260. This RUN feature permits the operator to access and display the estimated time remaining for the completion of a job, a visual graph of the percent of completion of the job, and a paper stock or sheets required in trays 1, 2, and 3, and count of the output of sheets delivered. These job requirement features are accessed by pressing the RUN tab 274 which causes a run length work area to appear in the work selection area 240.

As seen in FIG. 5, the run length work area includes an estimated time remaining display 276 in hours and minutes and the percent of job complete graph generally shown at 278 including percent completed portion 280 suitably shaded and the percent to be completed portion 282 shown blank. Also illustrated are the sheets or paper stock required at tray 1 item 284, tray 2 item 286, tray 3 item 288, and a display 290 of the count of the sheets delivered at the output station of the machine. It should be noted that a bar graph 278 is illustrated but that any graphic display that is prominent, on the display screen and provides a visually prominent easily recognizable indication of the percent of completion of the job and/or the percent of the job to be completed would be suitable.

The estimated time remaining at 276 is preferably broken out into hours and minutes to accommodate the job length that may be required in a central reproduction facility. Similar to the bar graph 278, the time remaining display 276 is a running display that counts down to the completion of the job. However, the display 276 need not be as prominent and as observable from a long distance as the bar graph 278. It should be understood that the total estimated time to completion before initiation of the job is the first time that it is displayed in 276.

Display for three trays containing paper stock or copy sheets are illustrated at 284, 286, and 288. It should be understood that any number of trays are contemplated within the scope of the present invention, as well as different types of paper stock such as ordinary copy sheets, cover sheets, and various inserts such as tabs and dividers, including such things as transparencies. The total number or amount of paper stock required cannot be calculated or displayed, of course, until the exact number of documents in the set to be copied is known as well as the number of complete sets required. This information is determined in one of two ways. First the total number of documents in the set to be copied can be entered manually by the operator using the select keys 222 as shown in FIG. 3. In the second method the set of documents to be copied can be loaded in the recirculating document handler 26 as illustrated in FIG. 1 and the number of documents determined by slewing through the documents set in the recirculating document handler. This can be done in an automatic precount before the machine begins the actual reproduction run or the machine can actually reproduce the first set of the documents. A document count is displayed as illustrated in FIG. 5 at 292. Once the number of documents in a set is known, and the machine is programmed to a given number of sets, the total amount of paper stock can be determined.

Figure 6:
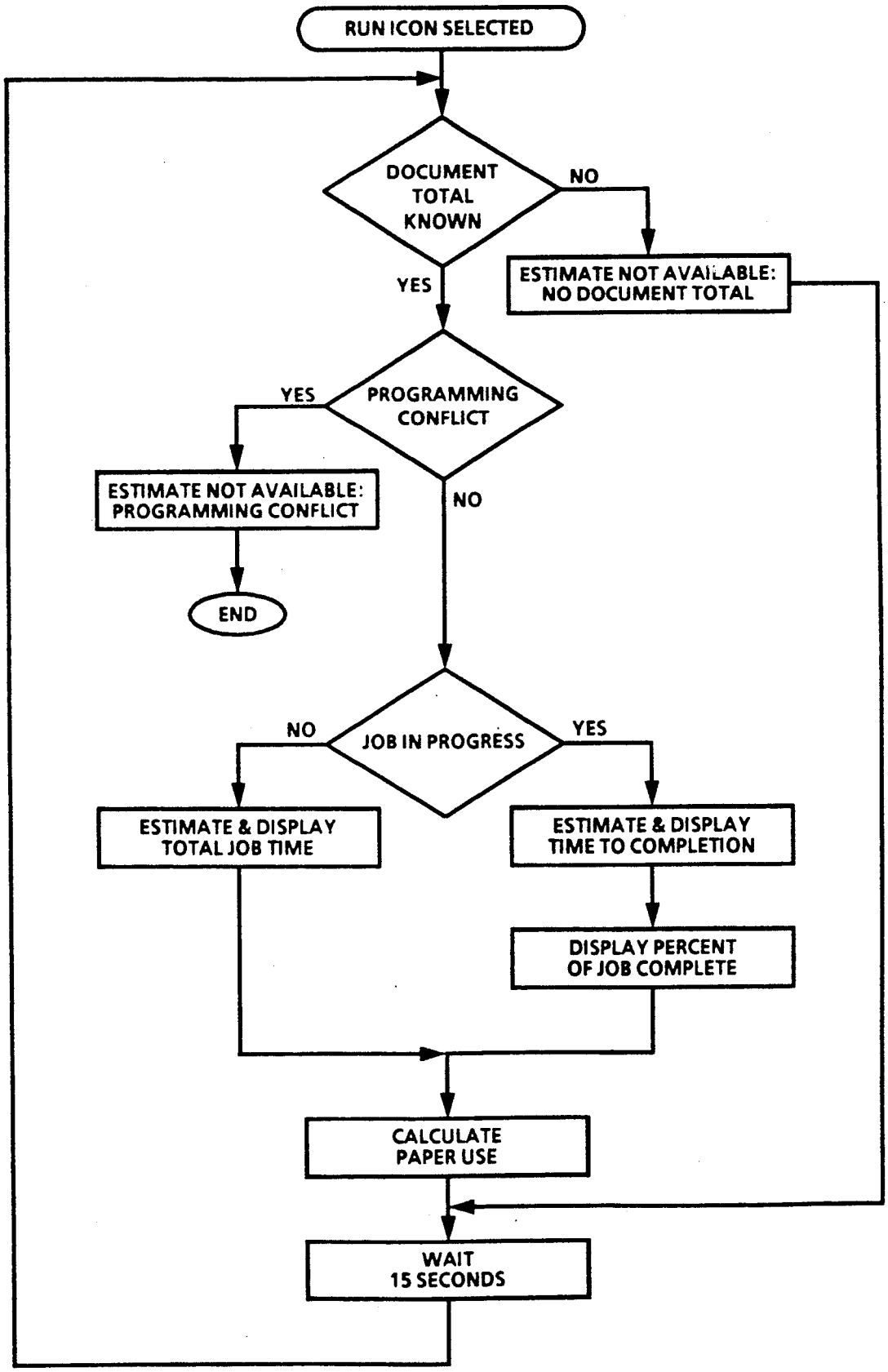
FIG. 6 is a flow chart depicting the operation of the displays shown in FIG. 5 in accordance with the present invention.

With reference to FIG. 6, there is illustrated the operation of the control in accordance with the present invention to display job completion percentage, job completion time, and paper stock required. Upon selection of the RUN icon 274, the first determination is whether or not the document total is known. If the document total is not known, there is a delay of fifteen seconds, in a preferred embodiment, to again recheck if the document total is known. At this time, presumably, the document total count will have been entered by the operator or the recirculating document handler will have rotated through a complete cycle of the document set in the recirculating document handler to determine the total number of documents in the set. If the number of documents in a set is known, the next step is to determine if there is a programming conflict. Various program conflicts such as found in exception programming or in the mode of copy of operation selected may preclude the initiation of the estimation calculations.

If there is no programming conflict, the next decision is to determine whether the job is in progress. If the job is not in progress, then the estimate will be of the total time to complete the job and this total time will be displayed at the display 276. This of course assumes that not only the number of documents in the set, but the number of sets requested in the job requirement are known. If the job is in progress, there is an estimation and display of the time to completion. The time to completion is determined as a percentage and suitably displayed on the bar graph 278. After the display of the job period completion time in the display 276 and after the manifestation of the percent of the job completed, if appropriate, in display 278, there is a calculation and display of paper use for each of the paper trays. The sheet or paper requirements are then suitably displayed in 284, 286 or 288. Also, the total number of sheets that will be delivered for the entire job will be displayed.

It should be noted that during a job in progress, an estimate of the time and completion of a second job can be made preferably a job that has already been pre-programmed. In this case, it will generally be necessary for the operator to enter a document count at the operator interface rather than rely upon a cycle of the recirculation document handler. However, once the job requirements for a second job are stored in memory, this data can be used during the running of a first job to determine the time to completion of the second job. While the invention has been described with reference to the structure disclosed, it is not confined to the details set forth, but is intended to cover such modifications or changes as may come within the scope of the following claims.

What is claimed is:

1. In a printing system having a machine with a plurality of operating components, a control with operator interface and display for entering job requirements, the control cooperating with the operating components to produce images on copy sheets, and a plurality of sources of copy sheets, the method of providing the time of completion for a given job requirement and providing an indication of the number of copy sheets required from each source of copy sheets including the steps of:

calculating the number of documents in a document set and the number of sets required, determining whether or not the job is in progress, graphically displaying the percentage completion of the job, and calculating the requirements for each of the copy sheet sources, and displaying the number of sheets required from each of the sources.

2. In a printing system having a machine with a plurality of operating components, a control with operator interface and display for entering job requirements, the control cooperating with the operating components to produce images on paper stock, and a plurality of sources of paper stock, the method of providing an indication of the amount of paper stocky required from each source of paper stock including the steps of calculating the number of documents in a document set and the number of sets required, and determining the requirements for each of the paper stock sources, and displaying the number of pieces required from each of the sources.

3. The method of claim 2 including the step of determining and graphically displaying the percentage of time to completion of the job run.

4. The method claim of 2 wherein the paper stock includes covers and dividers.

5. The method of claim 2 wherein the paper stock includes transparencies.

6. In a printing system having a machine with a plurality of operating components and a control with operator interface and display for entering job requirements, the control cooperating with the operating components to produce images on copy sheets, the method of providing the time of completion for a given job requirement including the steps of:

responding to the entered job requirements for a first job run to calculate a total time of completion for the first job run.

displaying the total time of completion at the operator interface, initiating the first job run and during the first job run determining the time to completion of a second job run.

7. The method of claim 6 including the step of visually displaying time to completion of the second job run.

8. The method of claim 7, wherein the visual display includes a visually prominent bar graph.

* * * * *